US007361004B2

(12) United States Patent
Hwang et al.

(10) Patent No.: US 7,361,004 B2
(45) Date of Patent: Apr. 22, 2008

(54) COMPRESSION UNIT OF ORBITING VANE COMPRESSOR

(75) Inventors: Seon-woong Hwang, Anyang-Si (KR); Dong-won Yoo, Seoul (KR); Myung-kyun Kiem, Bucheon-Si (KR)

(73) Assignee: LG Electronics Inc., Seoul (KR)

( * ) Notice: Subject to any disclaimer, the term of this patent is extended or adjusted under 35 U.S.C. 154(b) by 39 days.

(21) Appl. No.: 11/208,532

(22) Filed: Aug. 23, 2005

(65) Prior Publication Data

US 2006/0127256 A1 Jun. 15, 2006

(30) Foreign Application Priority Data

Dec. 14, 2004 (KR) ..... 10-2004-0105655

(51) Int. Cl.
*F01C 1/02* (2006.01)
*F01C 1/063* (2006.01)

(52) U.S. Cl. ..... 418/59; 418/63; 418/66; 418/124

(58) Field of Classification Search ..... 418/55.1–55.6, 418/59

See application file for complete search history.

(56) References Cited

U.S. PATENT DOCUMENTS 1,780,109 A * 10/1930 Berglund ..... 418/57
4,431,388 A * 2/1984 Eber et al. ..... 418/55.1
4,673,339 A * 6/1987 Hayano et al. ..... 418/15
4,708,607 A * 11/1987 Hayano et al. ..... 408/55.5
5,011,386 A * 4/1991 Guttinger ..... 418/59
2006/0127256 A1* 6/2006 Hwang et al. ..... 418/29

OTHER PUBLICATIONS

U.S. Appl. No. 11/111,862, to Hwang et al., which was filed on Apr. 22, 2005.

* cited by examiner

*Primary Examiner*—Thomas Denion
*Assistant Examiner*—Douglas J. Duff
(74) *Attorney, Agent, or Firm*—Greenblum & Bernstein, P.L.C.

(57) ABSTRACT

Disclosed herein is a compression unit of an orbiting vane compressor. The compression unit comprises a circular operation space formed in a cylinder, the circular operation space having opposite ends, a circular vane disposed in the operation space for performing an orbiting movement, the circular vane having opposite ends, a linear slider disposed in the operation space for performing a linear reciprocating movement while one end of the linear slider is in contact with the end of the circular vane, and a pressurizing member disposed in the operation space adjacent to the other end of the linear slider for applying pressure to the linear slider such that the linear slider is brought into tight contact with the circular vane. Consequently, interference between the inner wall of the cylinder and the circular vane is prevented, and creation of dead volume in the operation space is prevented.

16 Claims, 6 Drawing Sheets

COMPRESSION UNIT OF ORBITING VANE COMPRESSOR

BACKGROUND OF THE INVENTION

1. Field of the Invention

The present invention relates to an orbiting vane compressor, and, more particularly, to a compression unit of an orbiting vane compressor comprising a slider formed in a linear shape such that the slider can be easily manufactured and the slider can perform a linear reciprocating movement wherein interference between the inner wall of a cylinder defining an operation space of the cylinder and a circular vane is prevented, and creation of dead volume in the operation space is prevented.

2. Description of the Related Art

Generally, an orbiting vane compressor is constructed to form inner and outer compression chambers in a cylinder as an orbiting vane performs an orbiting movement in the cylinder. FIG. 1 illustrates a low-pressure sealed type refrigerant compressor that is applicable as a sealed type refrigerant compressor, such as is used in a refrigerator or an air conditioner, which has been proposed by the applicant of the present application.

As shown in FIG. 1, a drive unit D and a compression unit P are mounted in a shell 1 while the drive unit D and the compression unit P are hermetically sealed. The drive unit D and the compression unit P are connected to each other via a vertical crankshaft 8, the upper and lower ends of which are rotatably supported by a main frame 6 and a subsidiary frame 7, such that power from the drive unit D is transmitted to the compression unit P through the crankshaft 8.

The drive unit D comprises: a stator 2 fixedly disposed between the main frame 6 and the subsidiary frame 7; and a rotor 3 disposed in the stator 2 for rotating the crankshaft 8, which vertically extends through the rotor 3, when electric current is supplied to the rotor 3. The rotor 3 is provided at the top and bottom parts thereof with balance weights 3*a*, which are disposed symmetrically to each other for preventing the crankshaft 8 from being rotated in an unbalanced state due to a crank pin 81.

The compression unit P comprises an orbiting vane 5 having a boss 55 formed at the lower part thereof. The crank pin 81 is fixedly fitted in the boss 55 of the orbiting vane 5. As the orbiting vane 5 performs an orbiting movement in a cylinder 4, refrigerant gas introduced into the cylinder 4 is compressed. The cylinder 4 comprises an inner ring 41 integrally formed at the upper part thereof while being protruded downward. The orbiting vane 5 comprises a circular vane 51 formed at the upper part thereof while being protruded upward. The circular vane 51 performs an orbiting movement in an annular space 42 defined between the inner ring 41 and the inner wall of the cylinder 4. Through the orbiting movement of the circular vane 51, inner and outer compression chambers are formed at the inside and the outside of the circular vane 51, respectively. Refrigerant gases compressed in the inner and outer compression chambers are discharged out of the cylinder 4 through inner and outer outlet ports 44 and 44*a* formed at the upper part of the cylinder 4, respectively.

Between the main frame 6 and the orbiting vane 5 is disposed an Oldham's ring 9 for preventing rotation of the orbiting vane 5. Through the crankshaft 8 is longitudinally formed an oil supplying channel 82 for allowing oil to be supplied to the compression unit P therethrough when an oil pump 83 mounted at the lower end of the crankshaft 8 is operated.

The illustrated conventional orbiting vane compressor is a low-pressure orbiting vane compressor wherein refrigerant gas compressed by the compression unit P is discharged to a high-pressure chamber 12 formed at the upper part of the shell 1 through the inner and outer outlet ports 44 and 44*a* of the cylinder 4. An outlet tube 13, which penetrates the shell 1, communicates with the high-pressure chamber 12. An inlet tube 11 is disposed below the outlet tube 13. Specifically, the inlet tube 11 penetrates the shell 1 such that the inlet tube 11 communicates with one side of the main frame 6.

When electric current is supplied to the drive unit D, the rotor 3 of the drive unit D is rotated, and therefore, the crankshaft 8 is also rotated. As the crankshaft 8 is rotated, the orbiting vane 5 of the compression unit P performs an orbiting movement along the annular space 42 defined between the inner ring 41 and the inner wall of the cylinder 4 while the crank pin 81 of the crankshaft 8 is eccentrically fitted in the boss 55 formed at the lower part of the orbiting vane 5.

As a result, the circular vane 51 of the orbiting vane 5, which is inserted in the annular space 42 defined between the inner ring 41 and the inner wall of the cylinder 4, also performs an orbiting movement to compress refrigerant gas introduced into the annular space 42. At this time, the inner and outer compression chambers are formed at the inside and the outside of the circular vane 51 in the annular space 41, respectively. Refrigerant gases compressed in the inner and outer compression chambers are guided to the high-pressure chamber 12 through the inner and outer outlet ports 44 and 44*a* formed at the upper part of the cylinder 4, which communicate with the inner and outer compression chambers, respectively, and are then discharged out of the orbiting vane compressor through the outlet tube 13. In this way, high-temperature and high-pressure refrigerant gas is discharged.

FIG. 2 is an exploded perspective view illustrating the structure of the compression unit of the conventional orbiting vane compressor shown in FIG. 1.

In the compression unit P of the orbiting vane compressor, as shown in FIG. 2, the orbiting vane 5, which is connected to the crankshaft 8, is disposed on the upper end of the main frame 6, which rotatably supports the upper part of the crankshaft 8. The cylinder 4, which is attached to the main frame 6, is disposed above the orbiting vane 5. The cylinder 4 is provided at a predetermined position of the circumferential part thereof with an inlet port 43. The inner and outer outlet ports 44 and 44*a* are formed at predetermined positions of the upper end of the cylinder 4.

At a predetermined position of the circumferential part of the circular vane 51 of the orbiting vane 5 is formed a through-hole 52 for allowing refrigerant gas introduced through the inlet port 43 of the cylinder 4 to be guided into the circular vane 51 therethrough. The through-hole 52 is opened to the upper part of the circular vane 51 and to a slider 54. The slider 54 is disposed in an opening 53, which is formed at another predetermined position of the circumferential part of the circular vane 51 of the orbiting vane 5 while being adjacent to the position where the through-hole 52 is formed, for maintaining the seal between low-pressure and high-pressure sides defined in the cylinder 4.

FIG. 3 is a cross-sectional view illustrating the compressing operation of the compression unit of the conventional orbiting vane compressor shown in FIG. 2.

When the orbiting vane 5 of the compression unit P is driven by power transmitted to the compression unit P from the drive unit D through the crankshaft 8 (see FIG. 1), the circular vane 51 of the orbiting vane 5 disposed in the annular space 42 of the cylinder 4 performs an orbiting movement in the annular space 42 defined between the inner ring 41 and the inner wall of the cylinder 4, as indicated by arrows, to compress refrigerant gas introduced into the annular space 42 through the inlet port 43.

At the initial orbiting position of the orbiting vane 5 of the compression unit P (i.e., the 0-degree orbiting position), refrigerant gas is introduced into an inner suction chamber A1 through the inlet port 43 and the through-hole 52 of the circular vane 51, and compression is performed in an outer compression chamber B2 while the outer compression chamber B2 does not communicate with the inlet port 43 and the outer outlet port 44*a*. Refrigerant gas is compressed in an inner compression chamber A2, and at the same time, the compressed refrigerant gas is discharged out of the inner compression chamber A2.

At the 90-degree orbiting position of the orbiting vane 5 of the compression unit P, the compression is still performed in the outer compression chamber B2, and almost all the compressed refrigerant gas is discharged out of the inner compression chamber A2 through the inner outlet port 44. At this stage, an outer suction chamber B1 appears so that refrigerant gas is introduced into the outer suction chamber B1 through the inlet port 43.

At the 180-degree orbiting position of the orbiting vane 5 of the compression unit P, the inner suction chamber A1 disappears. Specifically, the inner suction chamber A1 is changed into the inner compression chamber A2, and therefore, compression is performed in the inner compression chamber A2. At this stage, the outer compression chamber B2 communicates with the outer outlet port 44*a*. Consequently, compressed refrigerant gas is discharged out of the outer compression chamber B2 through the outer outlet port 44*a*.

At the 270-degree orbiting position of the orbiting vane 5 of the compression unit P, almost all the compressed refrigerant gas is discharged out of the outer compression chamber B2 through the outer outlet port 44*a*, and the compression is still performed in the inner compression chamber A2. Also, compression is newly performed in the outer suction chamber B1. When the orbiting vane 5 of the compression unit P further performs the orbiting movement by 90 degrees, the outer suction chamber B1 disappears. Specifically, the outer suction chamber B1 is changed into the outer compression chamber B2, and therefore, the compression is continuously performed in the outer compression chamber B2. As a result, the orbiting vane 5 of the compression unit P is returned to the position where the orbiting movement of the orbiting vane 5 is initiated. In this way, a 360-degree-per-cycle orbiting movement of the orbiting vane 5 of the compression unit P is accomplished. The orbiting movement of the orbiting vane 5 of the compression unit P is performed in a continuous fashion.

In the conventional orbiting vane compressor with the above-stated construction, however, the slider, which maintains the seal between the low-pressure and high-pressure sides defined in the cylinder, is formed in the shape of an arc such that the slider is brought into tight contact with the inner wall of the cylinder defining the annular space. As a result, the manufacture of the slider is very difficult. If the surface process of the slider is not accurately accomplished, and therefore, the slider is not brought into tight contact with the inner wall of the cylinder, interference and frictional wear occur between the slider and the inner wall of the cylinder when the slider is reciprocated as the circular vane performs an orbiting movement along the annular space of the cylinder. According to circumstances, the slider and the inner wall of the cylinder may even be damaged.

SUMMARY OF THE INVENTION

Therefore, the present invention has been made in view of the above problems, and it is an object of the present invention to provide a compression unit of an orbiting vane compressor comprising a slider formed in a linear shape such that the slider can be easily manufactured and the slider can perform a linear reciprocating movement wherein interference between the inner wall of a cylinder defining an operation space of the cylinder and a circular vane is prevented, and creation of dead volume in the operation space is prevented.

In accordance with the present invention, the above and other objects can be accomplished by the provision of a compression unit of an orbiting vane compressor, comprising: a circular operation space formed in a cylinder, the operation space having opposite ends separated from each other by a closing part, the operation space having a linear part, which is formed at one end of the operation space, extending in the tangential direction; a circular vane disposed in the operation space for performing an orbiting movement to compress refrigerant gas introduced into the operation space, the circular vane having opposite ends separated from each other by partially cutting the circular vane; and a sealing unit brought into contact with one end of the circular vane.

Preferably, the circular vane has a linear part, which is formed at one end of the circular vane, extending by an orbiting radius of the circular vane.

Preferably, the operation space of the cylinder is divided into inner and outer compression chambers by the circular vane, the cylinder has inner and outer outlet ports, which communicate with the inner and outer compression chambers, respectively, and the inner and outer outlet ports are disposed adjacent to the end of the circular vane where the linear part is formed.

Preferably, the sealing unit comprises: a linear slider disposed in the operation space, which has linear slide contact surfaces, for performing a linear reciprocating movement while one end of the linear slider is in contact with the end of the circular vane; and a pressurizing member disposed in the operation space adjacent to the other end of the linear slider for applying pressure to the linear slider such that the linear slider is brought into tight contact with the circular vane.

Preferably, the pressurizing member is a gas discharge hole formed at the cylinder within the operation space adjacent to the other end of the linear slider for allowing the pressure of refrigerant gas discharged into the operation space therethrough to be applied to the linear slider such that the linear slider is brought into tight contact with the end of the circular vane.

Preferably, the pressurizing member is a spring resiliently disposed in the operation space adjacent to the other end of the linear slider for resiliently pushing the linear slider such that the linear slider is brought into tight contact with the end of the circular vane.

BRIEF DESCRIPTION OF THE DRAWINGS

The above and other objects, features and other advantages of the present invention will be more clearly understood from the following detailed description taken: in conjunction with the accompanying drawings, in which.

DESCRIPTION OF THE PREFERRED EMBODIMENTS

Now, a preferred embodiment of the present invention will be described in detail with reference to the accompanying drawings.

Figure 1:
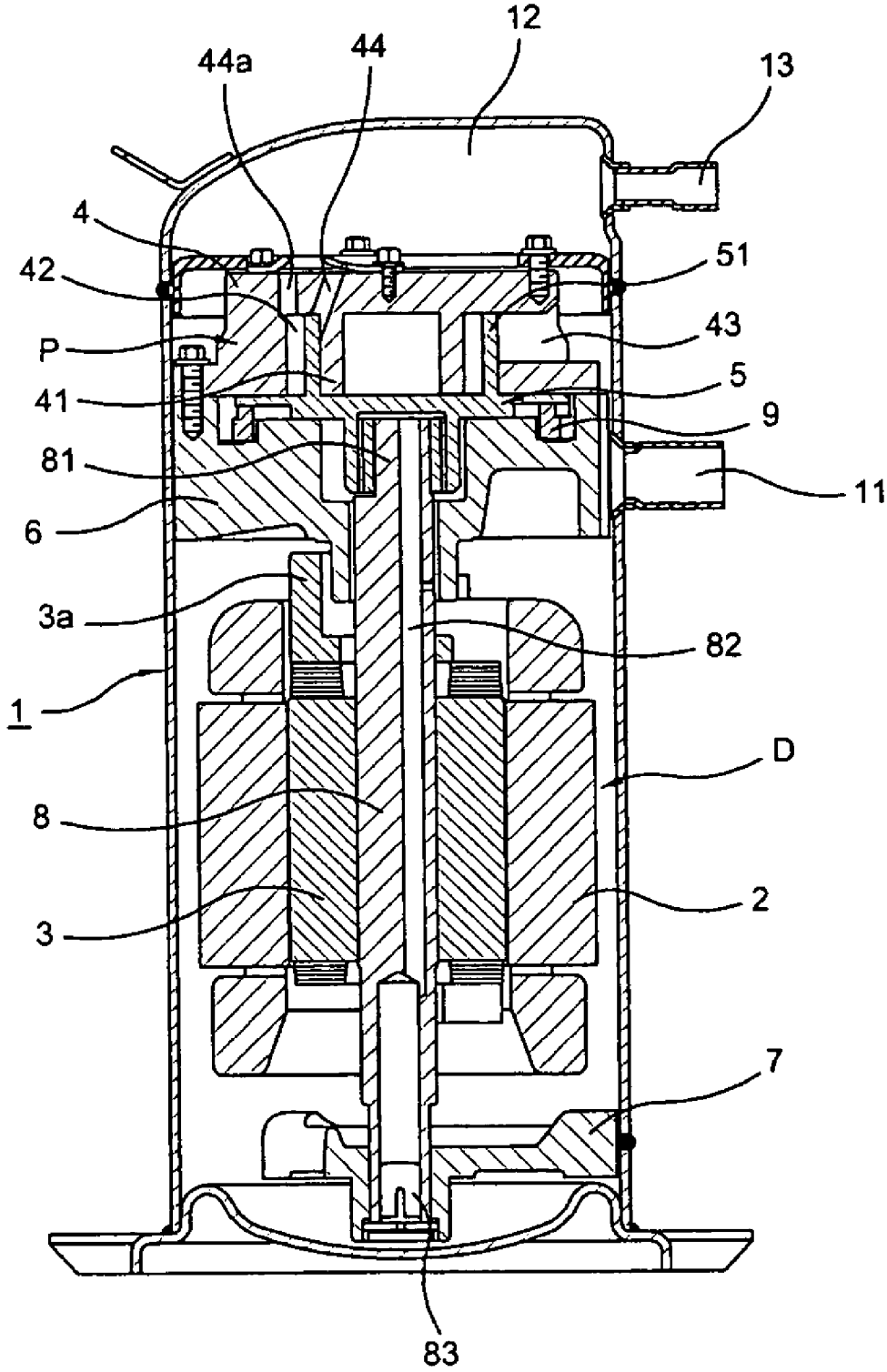
FIG. 1 is a longitudinal sectional view illustrating the overall structure of a conventional orbiting vane compressor.
Figure 2:
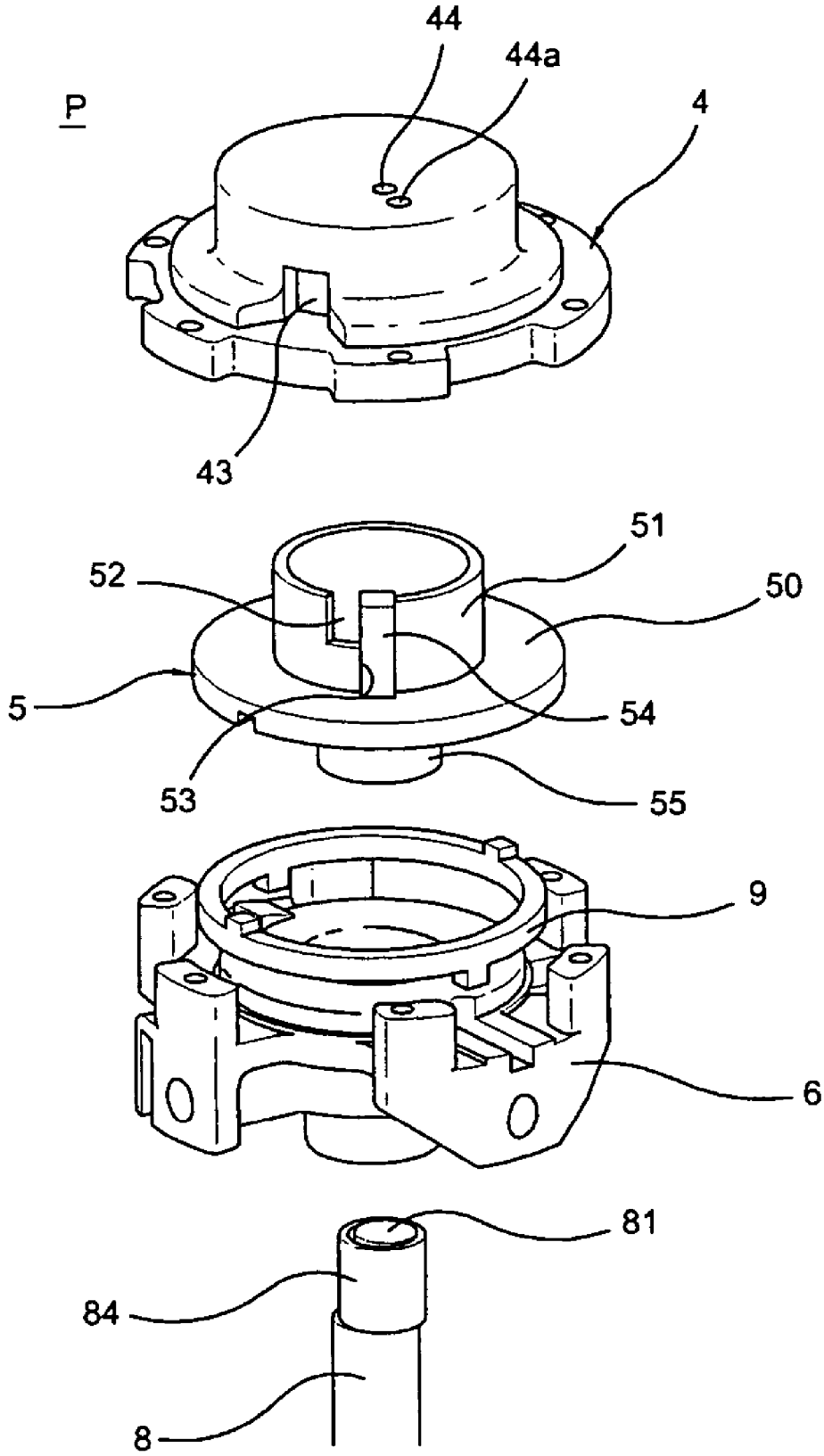
FIG. 2 is an exploded perspective view illustrating the structure of the compression unit of the conventional orbiting vane compressor shown in FIG. 1.
Figure 3:
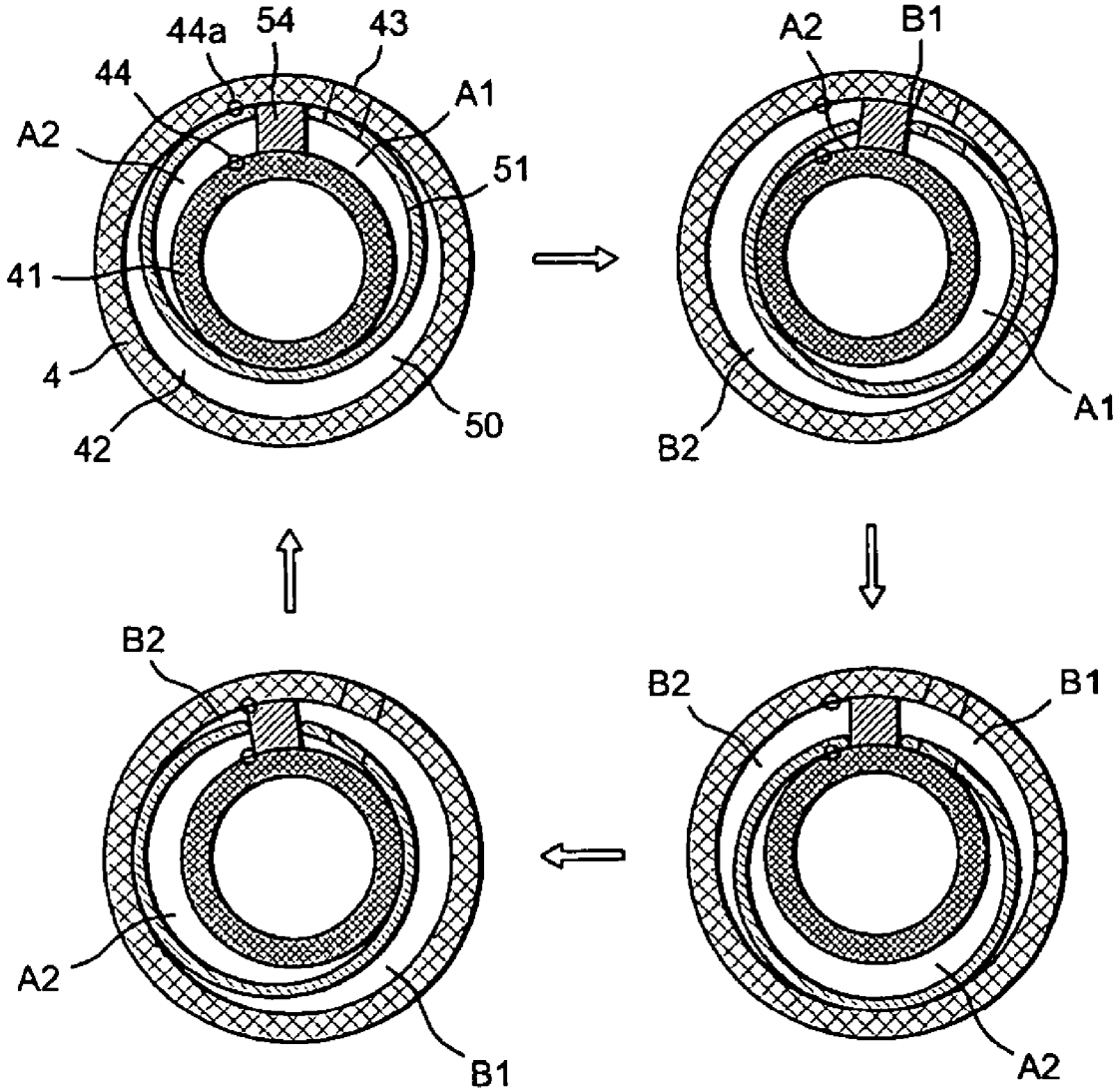
FIG. 3 is a cross-sectional view illustrating the compressing operation of the compression unit of the conventional orbiting vane compressor shown in FIG. 2.
Figure 4:
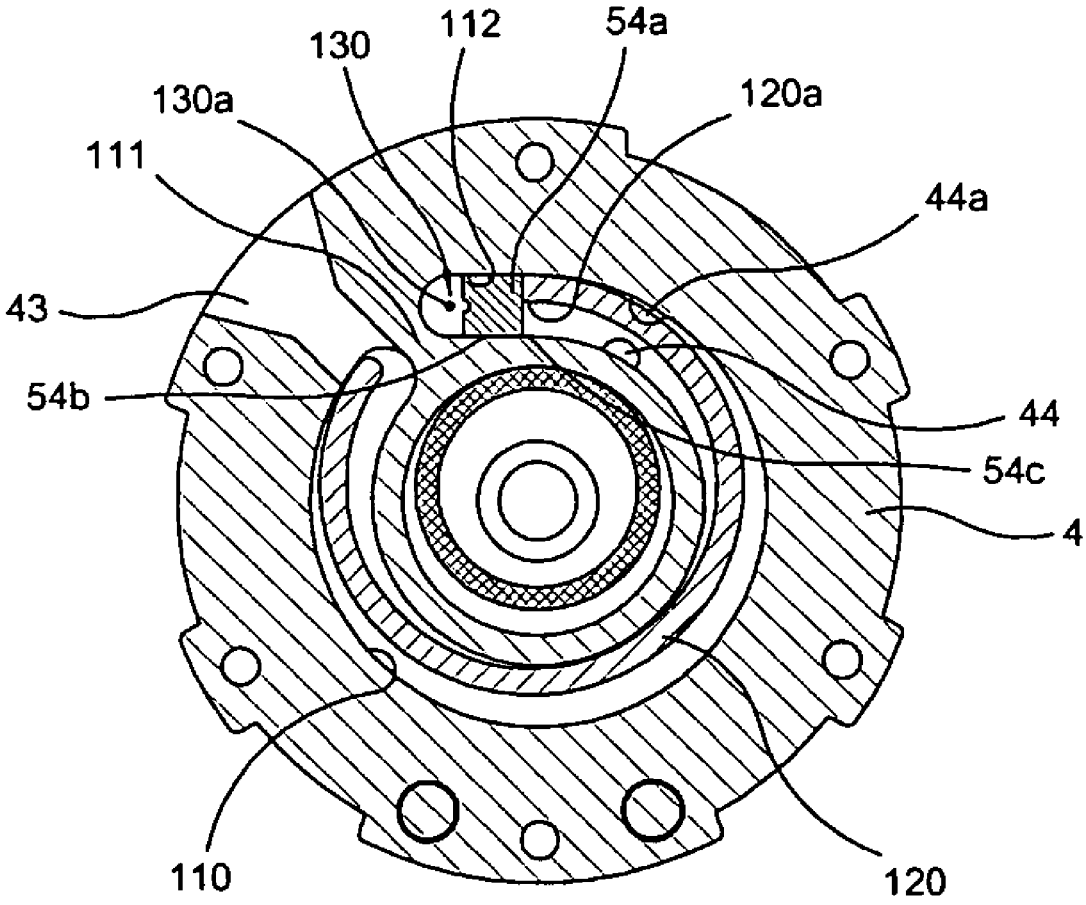
FIG. 4 is a plan view, in section, illustrating a compression unit of an orbiting vane compressor according to the present invention.

FIG. 4 is a plan view, in section, illustrating a compression unit of an orbiting vane compressor according to the present invention.

Generally, an orbiting vane compressor is constructed to form inner and outer compression chambers in a cylinder as a circular vane of an orbiting vane, to which power from a drive unit is transmitted through a crankshaft, performs an orbiting movement in the cylinder.

Referring to FIG. 4, a circular operation space 110 is formed in a cylinder 4. The circular operation space 110 has opposite ends separated from each other by a closing part 111. In the operation space 110 is disposed a circular vane 120, opposite ends of which are separated from each other by partially cutting the circular vane 120. Inner and outer compression chambers are formed at the inside and the outside of the circular vane 120 as the circular vane performs an orbiting movement along the operation space 110 of the cylinder 4.

The cylinder 4 has an inlet port 43, which is adjacent to one end of the circular vane 120, and inner and outer outlet ports 44 and 44*a*, which are adjacent to the other end of the circular vane 120. A sealing unit 130 is brought into contact with the end of the circular vane 120, which is adjacent to the inner and outer outlet ports 44 and 44*a* of the cylinder 4, for maintaining the seal between the inner and outer compression chambers.

The sealing unit 130 comprises: a linear slider 54*a* disposed in the operation space 110 such that one end of the linear slider 54*a* is brought into contact with the end of the circular vane 120; and a pressurizing member for applying pressure to the linear slider 54*a* such that the linear slider 54*a* is brought into tight contact with the circular vane 120.

Preferably, the linear slider is formed in the shape of a rectangular block.

In the illustrated embodiment of the present invention, the pressurizing member is a gas discharge hole 130*a*, which is formed at the cylinder 4 within the operation space 110 adjacent to the other end of the linear slider such that the gas discharge hole 130*a* communicates with the operation space 110. The pressure of refrigerant gas discharged into the operation space 110 through the gas discharge hole 130*a* is applied to the linear slider 54*a* such that the linear slider 54*a* is brought into tight contact with the end of the circular vane 120. The linear slider 54*a* has linear slide contact surfaces 54*b*, which are brought into contact with linear slide guide surfaces 54*c* formed at the end of the operation space 110.

Alternatively, the pressurizing member may be a spring resiliently disposed in the operation space 110 adjacent to the other end of the linear slider 54*a* for resiliently pushing the linear slider 54*a* such that the linear slider 54*a* is brought into tight contact with the end of the circular vane 120.

Figure 5A:
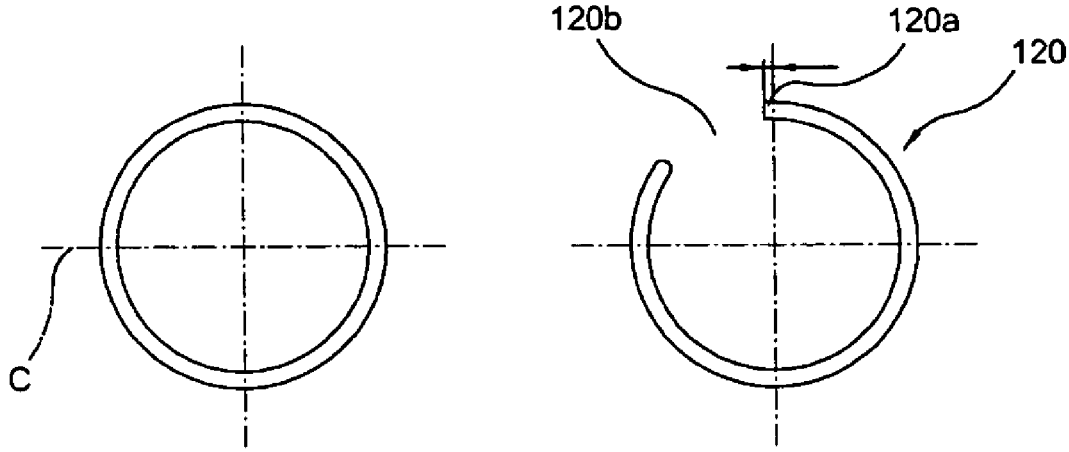
FIGS. 5A and 5B are plan views illustrating the structures of the circular vane and the operation space of the compression unit of the orbiting vane compressor according to the present invention shown in FIG. 4, respectively.
Figure 5B:
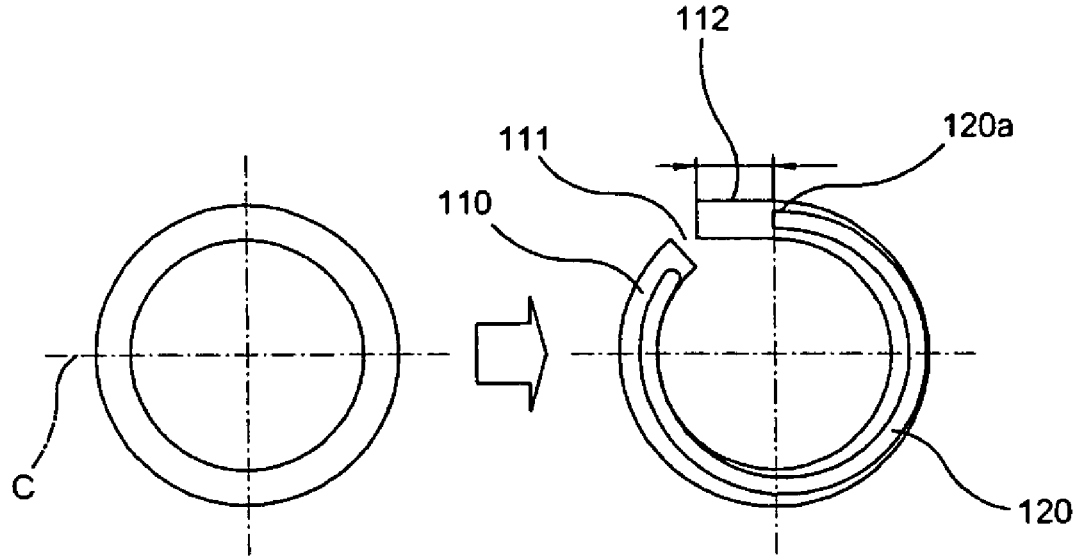

FIGS. 5A and 5B are plan views illustrating the structures of the circular vane and the operation space of the compression unit of the orbiting vane compressor according to the present invention shown in FIG. 4, respectively.

As shown in FIG. 5A, the circular vane 120 according to the present invention is formed in the shape of a circle having opposite ends separated from each other by partially cutting the circular vane 120. At the end of the circular vane 120 adjacent to the outlet port side of the cylinder is formed a linear part 120*a*, which extends by an orbiting radius of the circular vane 120 in the direction tangential to the circular vane 120 on the center line C.

As shown in FIG. 5B, the operation space 110 is formed in the shape of a circle having opposite ends separated from each other by the closing part 111. At the end of the operation space 110 adjacent to the outlet port side of the cylinder is formed a linear part 112, which extends in the direction tangential to the operation space 110 on the center line C.

Figure 6:
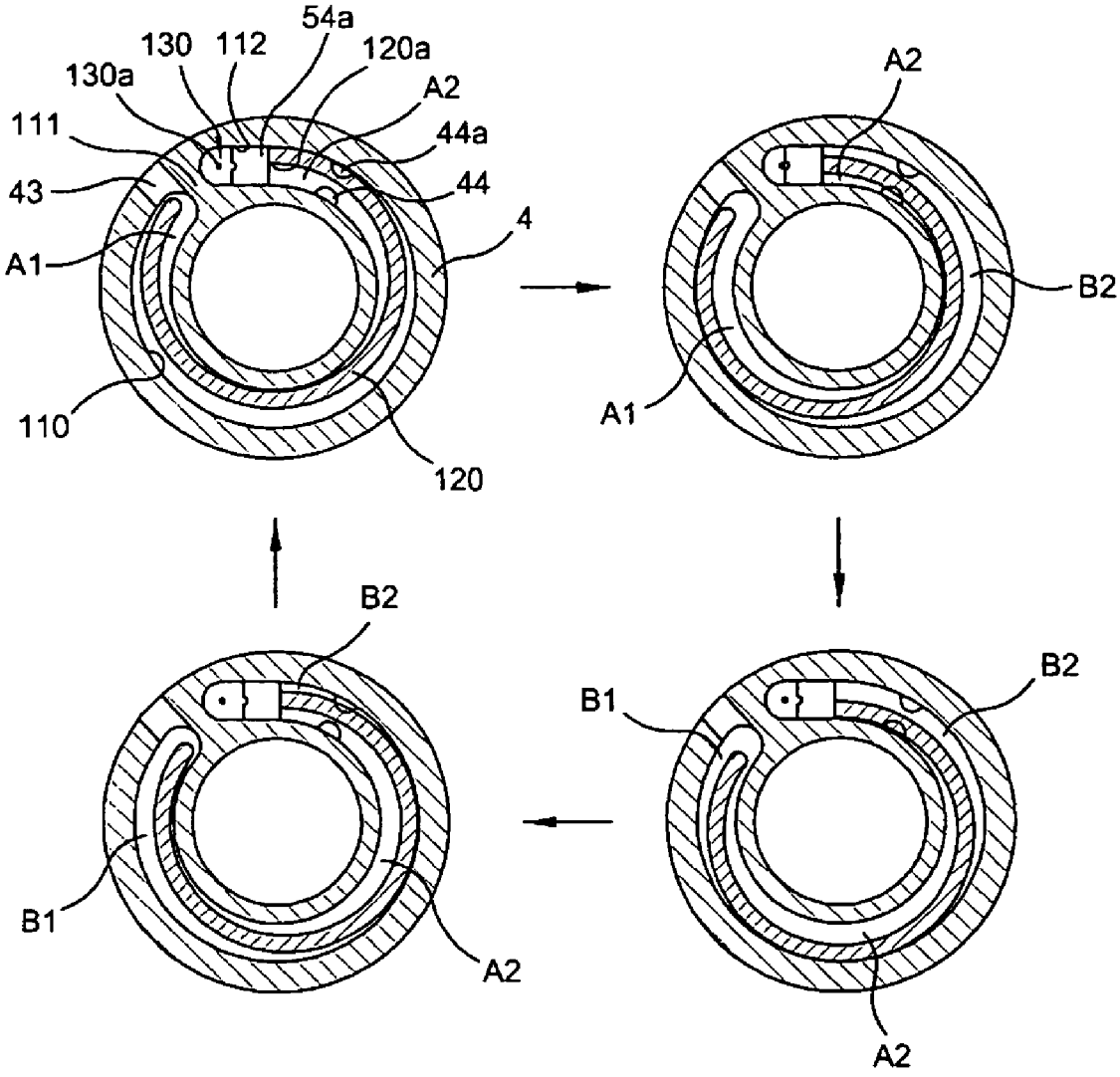
FIG. 6 is a cross-sectional view illustrating the compressing operation of the compression unit of the orbiting vane compressor according to the present invention shown in FIG. 4.

When the circular vane 120 disposed in the operation space 110 of the cylinder 4 performs an orbiting movement as shown in FIG. 6, refrigerant gas introduced into the operation space 110 through the inlet port 43 is compressed and discharged through the inner and outer outlet ports 44 and 44*a* of the cylinder 4. Some of the discharged refrigerant gas is introduced into the operation space 110 through the gas discharge hole 130*a*. As a result, the linear slider 54 is brought into tight contact with the corresponding end of the circular vane adjacent to the outlet port side of the cylinder, and therefore, the seal is maintained between the inner and outer compression chambers.

The compressing operation of the compression unit of the orbiting vane compressor according to the present invention will be described below in more detail.

At the initial orbiting position of the circular vane 120 (i.e., the 0-degree orbiting position), refrigerant gas is introduced into an inner suction chamber A1 through the inlet port 43, and compression is performed in an outer compression chamber B2, which is formed at the outside of the circular vane 120, while the outer compression chamber B2 does not communicate with the inlet port 43 and the outer outlet port 44*a*. Refrigerant gas is compressed in an inner compression chamber A2, which is formed at the inside of the circular vane 120, and at the same time, the compressed refrigerant gas is discharged out of the inner compression chamber A2.

At the 90-degree orbiting position of the circular vane 120, the compression is still performed in the outer compression chamber B2, and almost all the compressed refrigerant gas is discharged out of the inner compression chamber A2 through the inner outlet port 44. At this stage, an outer suction chamber B1 appears so that refrigerant gas is introduced into the outer suction chamber B1 through the inlet port 43.

At the 180-degree orbiting position of the circular vane 120, the inner suction chamber A1 disappears. Specifically, the inner suction chamber A1 is changed into the inner compression chamber A2, and therefore, compression is performed in the inner compression chamber A2. At this stage, the outer compression chamber B2 communicates with the outer outlet port 44*a*. Consequently, compressed refrigerant gas is discharged out of the outer compression chamber B2 through the outer outlet port 44*a*.

At the 270-degree orbiting position of the circular vane 120, almost all the compressed refrigerant gas is discharged out of the outer compression chamber B2 through the outer outlet port 44*a*, and the compression is still performed in the inner compression chamber A2. Also, compression is newly performed in the outer suction chamber B1. When the circular vane 120 further performs the orbiting movement by 90 degrees, the outer suction chamber B1 disappears. Specifically, the outer suction chamber B1 is changed into the outer compression chamber B2, and therefore, the compression is continuously performed in the outer compression chamber B2. As a result, the circular vane 120 is returned to the position where the orbiting movement of the circular vane 120 is initiated. In this way, a 360-degree-per-cycle orbiting movement of the circular vane 120 is accomplished. The orbiting movement of the circular vane 120 is performed in a continuous fashion.

According to the present invention as described above, the linear part 120*a*, which extends in the direction tangential to the circular vane 120, is formed at the end of the circular vane 120 adjacent to the outlet port side of the cylinder. Correspondingly, the linear part 112, which extends in the direction tangential to the operation space 110, is formed at the end of the operation space 110 adjacent to the outlet port side of the cylinder. Consequently, no dead volume is created in the operation space 110, and no interference occurs between the circular vane 120 and the inner wall of the cylinder in the operation space 110.

As apparent from the above description, the present invention provides a compression unit of an orbiting vane compressor comprising a slider formed in a linear shape such that the slider can be easily manufactured and the slider can perform a linear reciprocating movement wherein interference between the inner wall of a cylinder defining an operation space of the cylinder and a circular vane is prevented, and creation of dead volume in the operation space is prevented. Consequently, the present invention has the effect of easily and economically manufacturing the orbiting vane compressor, and improving performance and reliability of the orbiting vane compressor.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

What is claimed is:

1. A compression unit of an orbiting vane compressor, comprising:

a circular operation space formed in a cylinder, the operation space having opposite ends separated from each other by a closing part;

a circular vane disposed in the operation space for performing an orbiting movement to compress refrigerant gas introduced into the operation space, the circular vane having opposite ends separated from each other by partially cutting the circular vane; and a sealing unit brought into contact between one end of the circular vane and the closing part, the sealing unit comprising:

a linear slider disposed in the operation space, which has linear slide contact surfaces, for performing a linear reciprocating movement while one end of the linear slider is in contact with the end of the circular vane; and a pressurizing member disposed in the operation space adjacent to the other end of the linear slider for applying pressure to the linear slider such that the linear slider is brought into tight contact with the circular vane.

2. The compression unit as set forth in claim 1, wherein the operation space has a linear part, which is formed at one end of the operation space, extending in the tangential direction.

3. The compression unit as set forth in claim 1, wherein the circular vane has a linear part, which is formed at one end of the circular vane, extending by an orbiting radius of the circular vane.

4. The compression unit as set forth in claim 3, wherein the operation space of the cylinder is divided into inner and outer compression chambers by the circular vane, and the cylinder has inner and outer outlet ports, which communicate with the inner and outer compression chambers, respectively.

5. The compression unit as set forth in claim 4, wherein the inner and outer outlet ports are disposed adjacent to the end of the circular vane where the linear part is formed.

6. The compression unit as set forth in claim 1, wherein the linear slider is formed in the shape of a rectangular block.

7. The compression unit as set forth in claim 1, wherein the pressurizing member is a gas discharge hole formed at the cylinder within the operation space adjacent to the other end of the linear slider for allowing the pressure of refrigerant gas discharged into the operation space therethrough to be applied to the linear slider such that the linear slider is brought into tight contact with the end of the circular vane.

8. The compression unit as set forth in claim 1, wherein the pressurizing member is a spring resiliently disposed in the operation space adjacent to the other end of the linear slider for resiliently pushing the linear slider such that the linear slider is brought into tight contact with the end of the circular vane.

9. An orbiting vane compressor comprising:

a hermetically sealed shell having an inlet tube and an outlet tube; and a compression unit disposed in the shell, the compression unit being connected to one end of a crankshaft, which is rotated by a drive unit, wherein the compression unit comprises:

a cylinder having a circular operation space formed therein, the operation space having opposite ends separated from each other by a closing part;

a circular vane disposed in the operation space for performing an orbiting movement to compress refrigerant gas introduced into the operation space, the circular vane having opposite ends separated from each other by partially cutting the circular vane; and a sealing unit brought into contact between one end of the circular vane and the closing part, wherein the sealing unit comprises:

a linear slider disposed in the operation space, which has linear slide contact surfaces, for performing a linear reciprocating movement while one end of the linear slider is in contact with the end of the circular vane; and a pressurizing member disposed in the operation space adjacent to the other end of the linear slider for applying pressure to the linear slider such that the linear slider is brought into tight contact with the circular vane.

10. The compressor as set forth in claim 9, wherein the operation space has a linear part, which is formed at one end of the operation space, extending in the tangential direction.

11. The compressor as set forth in claim 9, wherein the circular vane has a linear part, which is formed at one end of the circular vane, extending by an orbiting radius of the circular vane.

12. The compressor as set forth in claim 9, wherein the linear slider is formed in the shape of a rectangular block.

13. The compressor as set forth in claim 9, wherein the pressurizing member is a gas discharge hole formed at the cylinder within the operation space adjacent to the other end of the linear slider for allowing the pressure of refrigerant gas discharged into the operation space therethrough to be applied to the linear slider such that the linear slider is brought into tight contact with the end of the circular vane.

14. The compressor as set forth in claim 9, wherein the pressurizing member is a spring resiliently disposed in the operation space adjacent to the other end of the linear slider for resiliently pushing the linear slider such that the linear slider is brought into tight contact with the end of the circular vane.

15. The compressor as set forth in claim 9, wherein the operation space of the cylinder is divided into inner and outer compression chambers by the circular vane, and the cylinder has inner and outer outlet ports, which communicate with the inner and outer compression chambers, respectively.

16. The compressor as set forth in claim 15, wherein the inner and outer outlet ports are disposed adjacent to the end of the circular vane where the linear part is formed.

* * * * *